US005172912A

United States Patent [19]

Lammertink

[11] Patent Number: 5,172,912

[45] Date of Patent: Dec. 22, 1992

[54] ROTATABLE MANIPULABLE PUZZLE

[75] Inventor: Ferdinand Lammertink, Hengelo, Netherlands

[73] Assignee: Binary Arts Corporation, Alexandria, Va.

[21] Appl. No.: 820,984

[22] Filed: Jan. 15, 1992

[51] Int. Cl.[5] ..... A63F 9/08

[52] U.S. Cl. ..... 273/153 S; 273/113

[58] Field of Search ..... 273/153 S, 155, 113, 273/115, 153 R

[56] References Cited

U.S. PATENT DOCUMENTS

| | | | |
|---|---|---|---|
| 598,889 | 2/1898 | Young | 273/153 R |
| 606,030 | 6/1898 | Rowell | 273/113 |
| 627,127 | 6/1899 | Mayhew | 273/153 R |
| 669,452 | 3/1901 | Ashby et al. | 273/113 |
| 679,782 | 8/1901 | Reenstierna | 273/113 |
| 1,071,874 | 9/1913 | Burbank | 273/153 R |
| 1,206,054 | 11/1916 | Trull | 273/153 S |
| 2,541,411 | 2/1951 | Culwell | 273/153 R |
| 3,749,405 | 7/1973 | Grattoni | 273/153 R |
| 4,376,537 | 3/1983 | Yokol | 273/153 |
| 4,413,823 | 11/1983 | Breslow | 273/153 |
| 4,487,417 | 12/1984 | Engel | 273/115 |
| 4,553,754 | 11/1985 | Wiggs et al. | 273/153 |
| 4,685,679 | 8/1987 | Ben-Gal et al. | 273/153 |
| 4,708,345 | 11/1987 | Ayers | 273/153 |
| 4,822,049 | 4/1989 | Biber | 273/110 |
| 4,877,248 | 10/1989 | Farraj | 273/153 |
| 4,881,738 | 11/1989 | Ayers | 273/153 |

FOREIGN PATENT DOCUMENTS

| | | |
|---|---|---|
| 83220939 | 12/1983 | Fed. Rep. of Germany . |
| 83/001009 | 3/1983 | PCT Int'l Appl. . |
| 85069010 | 10/1984 | U.S.S.R. . |
| 2116049 | 9/1983 | United Kingdom . |
| 2121693 | 1/1984 | United Kingdom . |

*Primary Examiner*—William H. Grieb
*Assistant Examiner*—Steven B. Wong
*Attorney, Agent, or Firm*—Leydig, Voit & Mayer

[57] ABSTRACT

A manipulable, two-sided, self-contained game puzzle with sequentially movable color-coded transfer members for selective movement between color-coded, collared apertures in a first rotatable member to color-coded, collared apertures of a second rotatable member where the first and second rotatable members are rotatably connected so that each of the collared apertures of one member can be brought into communication with each of the collared members of the second planar member during rotation thereof.

17 Claims, 3 Drawing Sheets

ROTATABLE MANIPULABLE PUZZLE

FIELD OF THE INVENTION

This invention relates to amusement and recreation devices of the solvable puzzle variety, and, more particularly, to a manipulable puzzle solvable by sequential displacement of coded geometric transferable members between correspondingly coded housing slots in two adjacent rotatable base members.

BACKGROUND OF THE INVENTION

Manipulable puzzles are very popular for recreation and amusement. In recent years, such puzzles have become increasingly challenging, spurred by the popularity and development of manipulable puzzles such as the Rubik's Cube®. Such devices are self-contained, challenging, and permit discontinuous activity without disrupting the progress toward the puzzle's solution. Furthermore, such puzzles promote hand-eye coordination as well as analytical thinking since they require the user to predict the result of each particular manipulation.

SUMMARY OF THE INVENTION

This invention relates to a self-contained, manipulable puzzle which satisfies the objectives of amusement, recreation, and interruptable use in a novel and attractive form. This invention, more particularly, provides a manipulable puzzle, comprising:

a selected plurality of substantially equally dimensioned transferable members;

a first generally planar member having an upper surface and a lower surface, said first planar member including a first selected number of first apertures extending in a first direction and a second selected number of second apertures extending in a second direction different from said first direction, said first and second apertures being spaced apart and the dimensions of said first and second apertures being equal to the dimensions of a selected integral number of said transferable members, said first planar member further including collars with lips formed around said first and second apertures on said upper surface, said lips on said collars defining an opening of a width less than the width of a said transferable member;

a second generally planar member having an upper and a lower surface, said second planar member including said first selected number of first apertures extending in a first direction and said second selected number of second apertures extending in a second direction different from said first direction, said first and second apertures being spaced apart and the dimensions of said first and second apertures being equal to the dimensions of a selected integral number of said transferable members, said second planar member further including collars with lips formed around said first and second apertures on said lower surface, said lips on said collars defining an opening of a width less than the width of a said transferable member;

connecting means for rotatably connecting said first and second planar members where said first apertures and second apertures of said first and second planar members, respectively, are alignable upon relative rotation of the first and second planar members to allow for sequential displacement of a selected one of said transferable members between said first and second members through the apertures therein.

Given the following enabling description of the drawings, the inventive, rotatable, manipulable puzzle should become evident to a person of ordinary skill in the art.

DETAILED DESCRIPTION OF THE ILLUSTRATED EMBODIMENT

Figure 1:
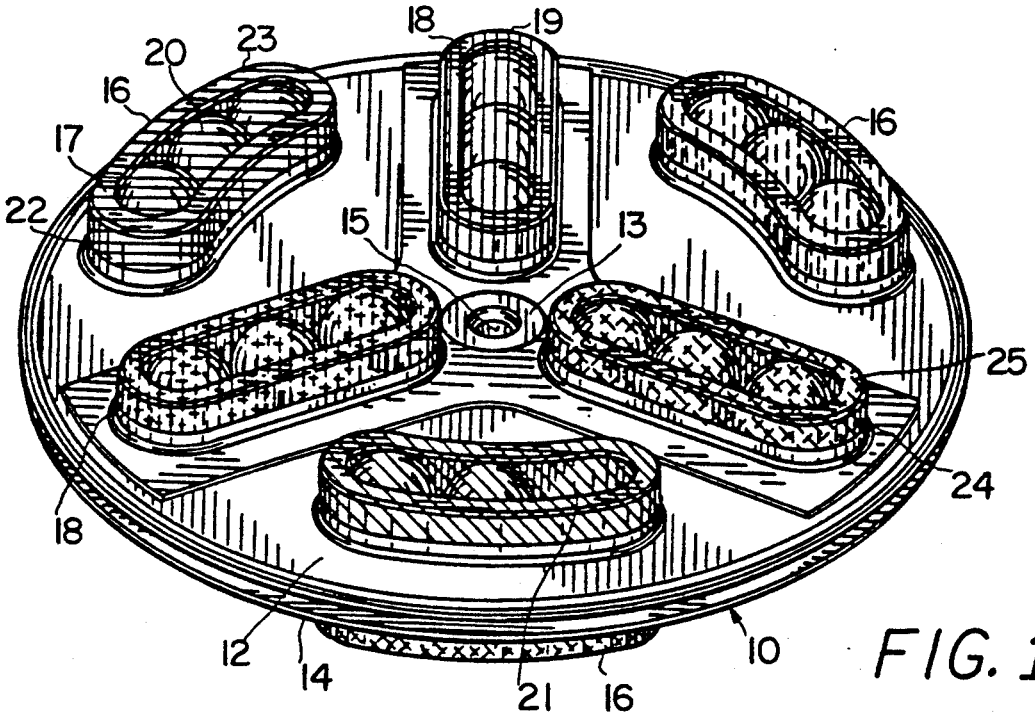
FIG. 1 is a perspective view of the inventive puzzle.

The manipulable puzzle of the invention is generally designated by 10. Puzzle 10 is a two sided puzzle which includes an upper base plate 12 and a lower base plate 14, both defining a disk with generally circular periphery and a generally planar configuration. The upper plate 12 and the lower plate 14 are rotatably joined at their center by hub 13 which may or may not include a central aperture 15 (for display, storage, etc.). By this arrangement, upper plate 12 and lower plate 14 are secured to each other where the lower surface of plate 12 is substantially adjacent the upper surface of base plate 14, are independently rotatable relative to each other, and permit communication of ball transfer members 20 between the plurality of openings 26 therein.

Each of upper base plate 12 and lower base plate 14 contain a plurality of circumferentially disposed slot housings 16 and radially disposed slot housings 18 formed about corresponding openings 26. The slot housings 16 and 18 of the upper base plate 12 are rotatably alignable with the slot housings 16 and 18, respectively, of the lower base plate 14. Furthermore, each of the circumferential slot housings 16 of one base plate can overlap, at least to the extent of one radius of transfer members 20, with each of the radial slot housings 18 on the other base plate.

Circumferential slot housings 16 are disposed substantially equidistantly from one another about an arc of the upper surface of base plate 12. Slot housings 16 are located near the perimeter of base 12. Radial slot housings 18 are disposed along substantially equally spaced radii on the upper surface of base plate 12. Radial slot housings 18 extend from near hub 13 to near the periphery of base 12. It is important that the slot housings 18, in part, extend in a radius corresponding to the arc in which circumferential slot housing 16 lies. In other words, a portion of the radial slot housing 18 must overlap the arc established by the circumferential slot housings 16 to permit alignment of slot housings 16 and 18 of base plate 12 with those of base plate 14.

Circumferential slot housing 16 features collar 17 which is defined by a combination of the vertical upstanding wall 22 and the lip 23. Correspondingly, the radial slot housings 18 include a collar 19 defined by the vertical wall 24 and the lip 25. The height (depth) of the collars 17 and 19 is substantially equal to one width (diameter) of the ball transfer members 20. As illustrated, the lips 23 and 25 lie in a plane substantially parallel to the base plates and extend inwardly above housings 16 and 18 to a distance sufficient to reduce the openings 26 to be smaller than the diameter of ball transfer members 20. Therefore, the lips 23 and 25 prevent the ball transfer members 20 from separating or being removed from the puzzle 10.

Figure 2:
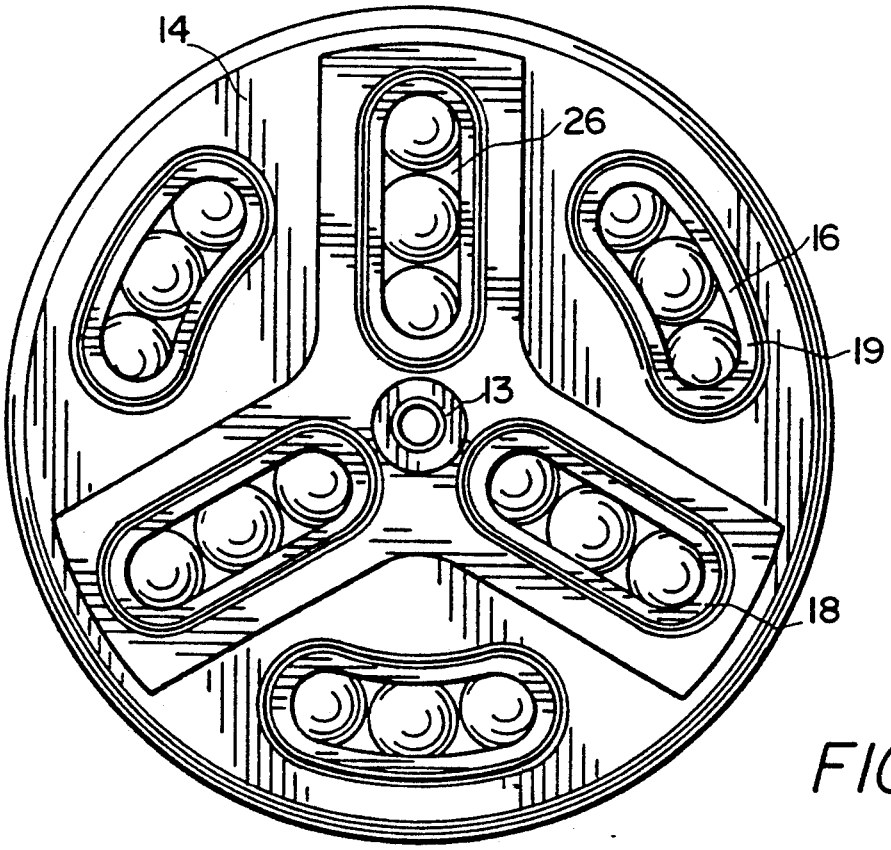
FIG. 2 is a top view of the puzzle.
Figure 3:
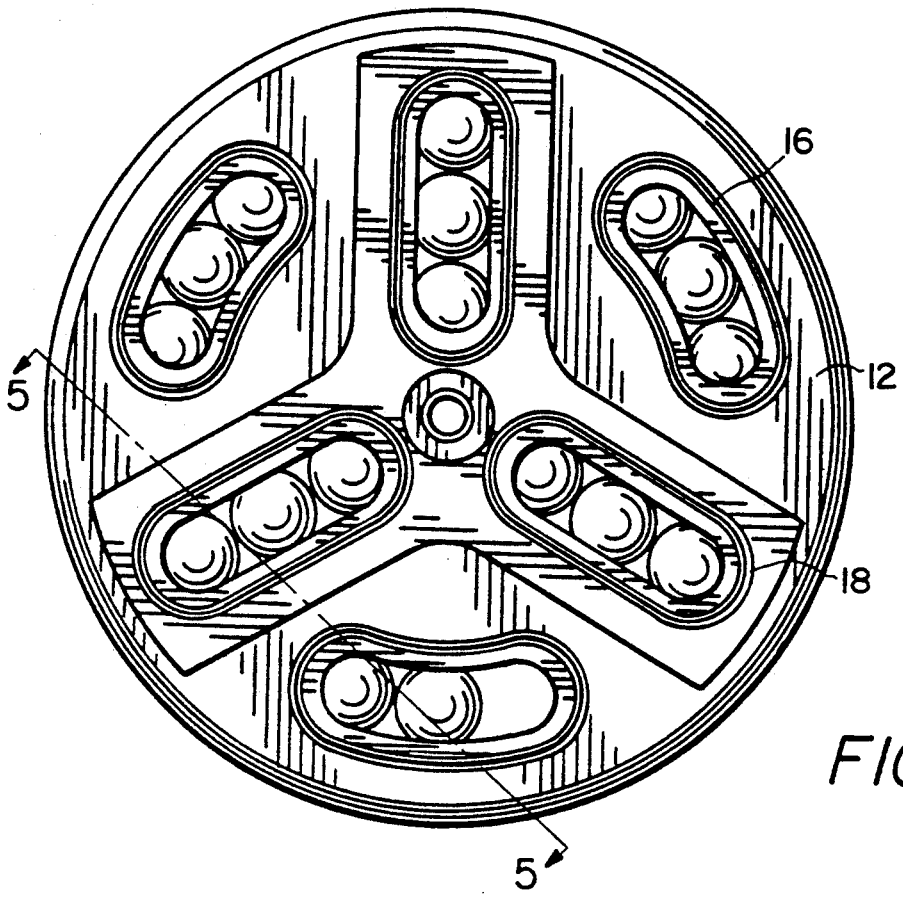
FIG. 3 is a bottom view of the puzzle.
Figure 4:
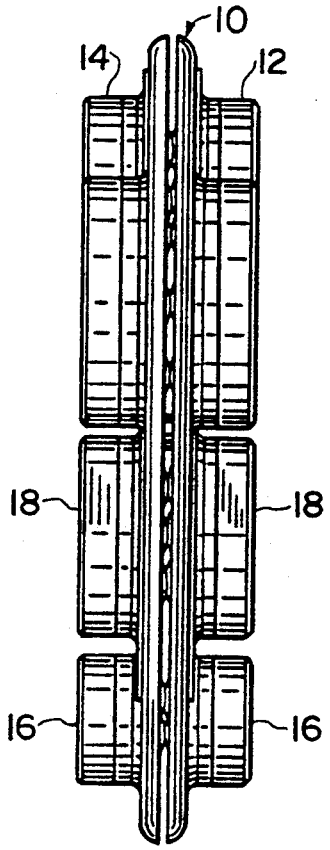
FIG. 4 is a side view of the inventive puzzle described herein.
Figure 5:
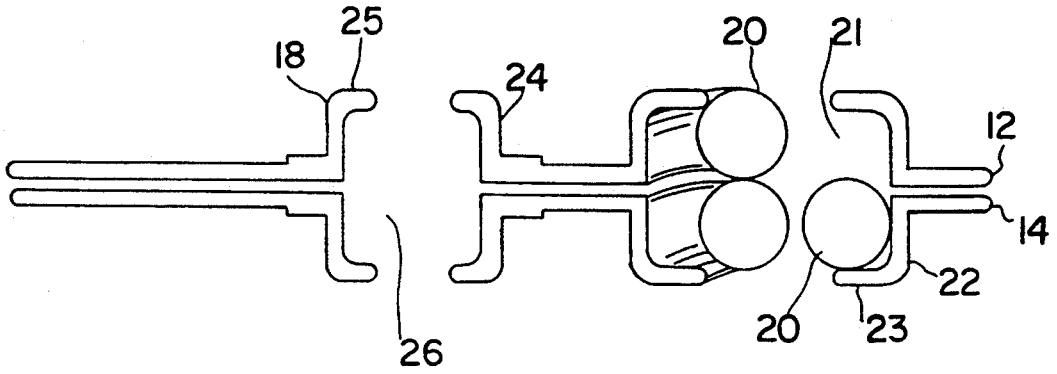
FIG. 5 is a cut-away view of the puzzle along the lines V—V in FIG. 1.

The slot housings 16 and 18 of the bottom plate 14 contain a full complement of ball transfer members (six sets of three). Accordingly, there are a total of eighteen balls contained in housings 16 and 18 in bottom plate 14, as illustrated in FIG. 2, while there are only seventeen balls (18 minus 1) in upper plate 12, as illustrated in FIG. 1. The absence of the one ball transfer member creates unoccupied/vacant area 21 which, therefore, corresponds to the dimensions of the one of ball transfer member 20 (see also FIG. 5). The vacant space 21 allows passing of one of ball transfer members 20 from a housing in one of the base plates to an aligned housing in the opposite base plate. Thus, the user switches one of the ball transfer members 20 into the vacant area 21, thus passing the vacant area 21 to the slot housings in the opposite base plate previously occupied by the selected ball transfer member. Therefore, by rotating and aligning the selected slot housings 16 and 18 on the opposite base plates, the puzzle 10 provides for ordered, sequential movement of the ball transfer members 20.

The slot housings 16 and 18 must be dimensioned to accommodate the selected number of and configuration of the ball transfer members 20 intended to be seated within each of the housings. The relative dimensions of the housings 16 and 18 and collars 17 and 19 are critical to preserve the integrity and self-contained nature of the puzzle 10. The lower surface of upper plate 12 defines apertures corresponding to the perimeter of the vertical walls 22 and 24. Similarly, the upper surface of lower plate 14 define such apertures.

The respective facing surfaces of the base plates 12 and 14 feature a plurality of spaced annular ridges and grooves disposed on the facing surface not occupied by the respective slot housings 16 and 18 (not illustrated). The ridges and grooves establish circumferential tracks which facilitate the relative rotation of the base plates by reducing frictional resistance of the ball transfer members 20 with the base plates.

In the commercial embodiment of the puzzle 10, the length of housings 16 and 18 substantially corresponds to three diameters (diameter$\times$3) of balls 20. The width of housings 16 and 18 corresponds to the diameter of one ball transfer member 20. Furthermore, as represented in FIG. 1, the ball transfer members 20 and the collars 17 and 19 are color coordinated to define specifically corresponding colored sets. Each of the collars in base plate 12 are different colors, e.g., yellow, green, red, blue, orange, and purple. There are corresponding sets of three identically colored balls for each of the colored collars.

Bottom base plate 14, provides a similar arrangement to that described above, except that the selected colors of the collars and sets of ball transfer members may differ entirely or in part. In the commercial embodiment of the invention, the circumferential collars 17 of the upper base plate 12 are the same color as the radially extending collars 19 of the bottom plate 14. Therefore, the commercial embodiment of the puzzle 10 features twelve sets of ball transfer members 20 and nine different colors. One of the non-duplicated color ball sets includes only two balls, thereby providing unoccupied area 21 in top plate 12.

Given the above structural description, the object and an exemplary method of play of manipulable puzzle 10 is now described. The respective base plates are rotated circumferentially and the slot housings aligned to pass one ball 20 into the oppositely disposed housing which contains the vacant space 21. The ball transfer members 20 are so passed between the respective housings of the upper and lower plates to scramble balls of different colors in collars of different colors. The objective is to minimize correspondence between the color of collars 17 and 19 and the colored ball transfer members 20 contained within the particular housings 16 and 18.

The user then initiates sequential movement of ball transfer members 20 with the object of matching the colored sets of balls with the corresponding colored collar(s) on both sides of the puzzle 10. To achieve this object, the user rotates the upper plate 12 relative to the lower plate 14 and switches one ball transfer member 20 at a time between the radial housings 18 and circumferential housings 16. In this fashion, the user manipulates the ball transfer members 20 into the housings 16 and 18 of corresponding color. When all of the respectively colored ball transfer members 20 are completely coordinated with the respectively colored housings, the puzzle has been solved.

As a manufacturing convenience, the invention is manufactured from molded thermoplastic components and colored plastic. However, it is not intended that the invention be so limited. The invention can be fabricated in wood, metal, etc. and combinations thereof.

As indicated above, there are several variations and modifications that can be made to the instant invention. For example, the transferable members, rather than being balls, could be any polygonal configuration so long as the members are substantially uniform in size and are able to be passed in an orderly sequence between the upper and lower base plates as well as capable of being retained within the collars.

The collars themselves may be open, as illustrated, or may be covered with a transparent, resilient covering.

The puzzle contemplates a plurality of ball transfer members 20. Thus, the number can be as few as two or as many as six or seven.

The number, length, and shape of the slot housings may be varied so long as the slot housings in the upper plate are able to maintain communication with the slot housings of the lower plate, directly or indirectly. The slot housings may all be dimensioned identically or may be of different lengths to accommodate different numbers of ball transfer members.

Each collar may possess multiple colors or indicia requiring each of the transfer members to be ordered relative to the puzzle 10. For example, each collar may feature numbers, letters, or other indicia which would require ordering the transferable members 20 sequentially within the housings relative to the entire puzzle (e.g. both slot housings and balls would be numbered 1–35).

This invention, in general, utilizes the basic concept of selecting x number of ball transfer members (2, 3, 4, 5, 6, 7, etc.) combined into y (at least two) different clusters of indicia and $x+1$ spaces combined into y different clusters. With respect to the space clusters, they must lie on the surface of the rotatable disks and at least one of the clusters of spaces must be directed radially relative to the rotatable disk. The other cluster(s) may be aligned circumferentially or even along a secant of the disks. For example, the space clusters may be in the shape of curved T's with the leg lying along a radius, a boomerang with one side lying along a radius, etc.

Given the foregoing, variations and modifications to the invention should now be apparent to the person having ordinary skill in the art. These variations and modifications are intended to fall within the scope and spirit of the invention as defined by the following claims.

I claim:

1. A manipulable puzzle, comprising:

a selected plurality of substantially equally dimensioned transferable members;

a first generally planar member having an upper surface and a lower surface, said first planar member including a first selected number of first apertures extending in a first direction and a second selected number of second apertures extending in a second direction different from said first direction, said first and second apertures being spaced apart and the dimensions of said first and second apertures being equal to the dimensions of a selected integral number of said transferable members, said first planar member further including collars with lips formed around said first and second apertures on said upper surface, said lips on said collars defining an opening of a width less than the width of a said transferable member;

a second generally planar member having an upper and a lower surface, said second planar member including said first selected number of first apertures extending in a first direction and said second selected number of second apertures extending in a second direction different from said first direction, said first and second apertures being spaced apart and the dimensions of said first and second apertures being equal to the dimensions of a selected integral number of said transferable members, said second planar member further including collars with lips formed around said first and second apertures on said lower surface, said lips on said collars defining an opening of a width less than the width of a said transferable member;

connecting means for rotatably connecting said first and second planar members where said first apertures and second apertures of said first and second planar members, respectively, are alignable upon relative rotation of the first and second planar members to allow for sequential displacement of a selected one of said transferable members between said first and second members through the apertures therein.

2. A puzzle according to claim 1 wherein said apertures are substantially the same length and width and the height of the collars is substantially equal to the cross-sectional length of one transferable member.

3. A puzzle according to claim 1 wherein said first and second planar members define circular disks and said first apertures are curved to correspond to the curvature of the perimeter of the base plate and said second apertures extend along equi-spaced radii of said first and second planar members.

4. A puzzle according to claim 2 wherein the transferable members are spheres and the first and second apertures have a length substantially equal to three aligned spheres and a width substantially equal to the width of one sphere.

5. A puzzle according to claim 4 wherein said collars define an open space for direct contact with the spheres.

6. A puzzle according to claim 3 wherein said collars define a selected plurality of colors and said transferable members are colored to correspond with said colored collars.

7. A puzzle according to claim 6 in which there are three radially disposed collared apertures and three circumferentially disposed collared apertures in each of said first and second planar members where each of the collared apertures is of a length corresponding to the diameter of said three transferable members and a width corresponding to one transferable member, where the collars and transferable members are respectively color-coded and the radial collared apertures of one of said planar members correspond to the colors of the second collared apertures of said second planar member.

8. A puzzle according to claim 7 further comprising means to reduce frictional engagement between the transferable members and the facing surfaces of said first and second planar members.

9. A puzzle according to claim 8 where said transferable members are spheres.

10. A manipulable puzzle, comprising:

a pair of generally planar rotatable members, a shaft upon which said rotatable members are journalled in a substantially abutting relationship, a plurality of substantially spherical transferable bodies, said bodies having a selected diameter, and bearing selected indicia;

a plurality of apertured first body containers formed in each of said pair of rotatable members and lying in a plane formed by and substantially parallel to that of said rotatable members, said first body containers extending in a first selected direction, bearing selected indicia corresponding to the indicia of said transferable bodies, and said first body containers having a length of a selected integral number of transferable body diameters and a width of one body diameter, said first body containers including means for maintaining contact of said transferable bodies with at least one of said rotatable members at all times; and a plurality of apertured second body containers formed in each of said pair of rotatable members, spaced apart from said first body containers and lying in a plane formed by and substantially parallel to that of said rotatable members, said second body containers extending in a second selected direction different from said first direction, said second body containers bearing selected indicia corresponding to selected indicia of said transferable bodies, and said second body containers having a length of a selected integral number of transferable body diameters and a width of one body diameter, said second body containers including means for maintaining contact of said transferable bodies with at least one of said rotatable members at all times, and said second body containers located on one of said rotatable members being capable of alignment, at least in part, with said first and second body containers of the other rotatable member upon rotation about said shaft.

11. A manipulable puzzle according to claim 10 wherein said rotatable members define circular disks and said first body containers are located along an arc corresponding to the curvature of the perimeter of the disks and said second body containers extend along radii of said disks.

12. A manipulable puzzle according to claim 10 where said means for maintaining are collars, said indicia define a selected plurality of colors, and said transferable bodies are colored to correspond with said colored collars.

13. A manipulable puzzle according to claim 12 where there are three radially disposed collared containers and three circumferentially disposed collared containers in each of said rotatable members and where each of the collared containers is of a length corresponding to the diameter of three transferable bodies and a width corresponding to one transferable body.

14. A manipulable puzzle according to claim 13 where the collars and bodies are respectively color-coded and the radial collared apertures of one of said planar members correspond to the colors of the second collared apertures of said second planar member.

15. A manipulable puzzle according to claim 14 where said collars further include lips which define an opening for direct contact with said transferable bodies.

16. A manipulable puzzle according to claim 10 wherein the transferable bodies are spheres and the first and second body containers have a length substantially equal to three sphere diameters and a width substantially equal to the width of one sphere diameter.

17. A puzzle according to claim 16 further comprising means to reduce frictional engagement between the spheres and the facing surfaces of said pair of rotatable members.

* * * * *